US008920203B2

(12) United States Patent
Harrington

(10) Patent No.: US 8,920,203 B2
(45) Date of Patent: Dec. 30, 2014

(54) MARKER BUOY

(71) Applicant: NIVO Innovations, LLC, Boise, ID (US)

(72) Inventor: Daniel P. Harrington, Boise, ID (US)

(73) Assignee: Nivo Innovations, LLC, Boise, ID (US)

( * ) Notice: Subject to any disclaimer, the term of this patent is extended or adjusted under 35 U.S.C. 154(b) by 205 days.

(21) Appl. No.: 13/712,249

(22) Filed: Dec. 12, 2012

(65) Prior Publication Data

US 2014/0162509 A1 Jun. 12, 2014

(51) Int. Cl.
*B63B 22/00* (2006.01)

(52) U.S. Cl.
CPC ..... *B63B 22/00* (2013.01)
USPC ..... 441/25

(58) Field of Classification Search
USPC ..... 441/21, 23–26
See application file for complete search history.

(56) References Cited

U.S. PATENT DOCUMENTS

| | | | | |
|---|---|---|---|---|
| 3,401,413 | A | 9/1968 | Anselmi | |
| 3,698,025 | A | 10/1972 | Worobel | |
| 3,775,787 | A | 12/1973 | Rager | |
| 3,829,919 | A | 8/1974 | Mathae | |
| 3,905,011 | A | 9/1975 | Nichols | |
| 3,906,564 | A * | 9/1975 | Thompson et al. | 441/25 |
| 3,918,113 | A | 11/1975 | Talkington | |
| 4,028,759 | A | 6/1977 | Toups | |
| 4,077,076 | A | 3/1978 | Masters | |
| 4,103,379 | A | 8/1978 | Wolfe | |
| 4,170,186 | A * | 10/1979 | Shaw | 114/264 |
| 4,280,237 | A | 7/1981 | Petrie | |
| 4,498,877 | A | 2/1985 | Rademakers | |
| 4,529,388 | A | 7/1985 | Jones et al. | |
| 4,544,364 | A | 10/1985 | Bankston | |
| 4,781,636 | A | 11/1988 | Schurr | |
| 4,808,133 | A | 2/1989 | Gram et al. | |
| 4,876,471 | A | 10/1989 | Baldwin | |
| 4,896,620 | A | 1/1990 | Jones | |
| 4,927,395 | A | 5/1990 | Sauinier et al. | |
| D310,792 | S | 9/1990 | Dalbec | |
| 5,087,216 | A | 2/1992 | Noggle | |
| 5,358,437 | A | 10/1994 | Allen | |
| 5,362,267 | A | 11/1994 | Forrest | |
| 5,376,035 | A | 12/1994 | Forrest | |
| 5,445,103 | A | 8/1995 | Bleth et al. | |
| 5,449,308 | A | 9/1995 | Thompson | |
| 5,766,049 | A | 6/1998 | Letourneau | |
| 5,803,780 | A | 9/1998 | Gutierrez, Jr. | |
| 6,086,439 | A | 7/2000 | Vasile | |
| 6,383,045 | B1 | 5/2002 | Eckardt | |
| 6,486,786 | B2 | 11/2002 | Chuang | |
| 6,709,304 | B1 | 3/2004 | Young | |
| 2004/0116012 | A1 | 6/2004 | Baldwin | |
| 2008/0085643 | A1 | 4/2008 | Nicholson | |

* cited by examiner

*Primary Examiner* — Edwin Swinehart
(74) *Attorney, Agent, or Firm* — Holland Law Office P.L.L.C.

(57) ABSTRACT

A marker buoy for marking a location vertically above an anchor deployed in a body of water, the marker buoy including a housing having a substantially watertight compartment and a spool mounted in an adjacent spool bay. A line for attachment to the anchor is wound onto the spool. When a force of tension on the line falls below the selected tension, a center of mass of the housing rotates about an axis of rotation of the housing. A control device responsive to such rotation causes energization of an electric motor coupled to the spool that operates until the force of tension on the line is again within the selected range of line tensions. The marker buoy is capable of autonomous operations, during lowering of the anchor, during operations to maintain a location vertically above the anchor, during retrieval of the anchor and during docking.

20 Claims, 5 Drawing Sheets

MARKER BUOY

BACKGROUND OF THE INVENTION

1. Technical Field

The present invention relates generally to floating marker buoys and more particularly to a buoy that automatically collects and stores excess line between the marker buoy and an attached anchor.

2. Background

The use of buoys to mark a wide variety of structures in fluid conditions, for instance underwater hazards, communications line and utility lines as well as and anchors and the like. A variety of devices for marking the position of an anchor used to moor a watercraft are described in the prior art. U.S. Pat. Nos. 6,383,045, 6,086,439, 5,445,103 and 4,077,076 disclose marker buoys that include a housing that contains a line wound on a reel assembly positioned within the housing. U.S. Pat. Nos. 6,383,045 and 5,445,103. U.S. Pat. No. 5,445,103 describe marker buoys that include a housing that houses a light source and a flexible line wound on a reel assembly positioned within the housing have been previously disclosed. U.S. Pat. No. 5,445,103 describes a marker buoy that includes a floating housing, a light, a battery, a spool with a line retractably held in the spool. In addition, the device described in the '103 patent describes a solar powered battery recharger. U.S. Pat. No. 5,449,308 describes a marker buoy that includes a drive motor mounted within a housing. The motor is activated by means of a toggle switch to manually toggle between on and off positions. U.S. Pat. No. 4,808,133 discloses a buoy system that automatically collects and stores excess line between a marker buoy and an anchor thereby minimizing the distance between the marker float and the anchor. A spring connected between the spool and the housing is tensioned as line is pulled from the spool provides the energy for line take-up.

Disadvantages persist in the design of marker buoys. To date there has not been provided a marker buoy that is capable of fully autonomous operation, from deployment of the buoy and an attached anchor, through operations wherein the buoy is capable of unattended line length compensation for waves, swells and tides so that the buoy remains at all times positioned substantially above the anchor on the water surface, through operations wherein the buoy and the attached anchor are retrieved and shipped and during the buoy operation while docked while the anchor is shipped. Many of the marker buoys commonly in use are set for a particular depth upon deployment and are incapable of self-adjusting the length of line deployed in order to maintain a relatively close position directly above the anchor, which is important if the buoy is to accurately indicate anchor location; too much line and the buoy no longer floats above the anchor, too little line and the buoy may become submerged. In those devices that are capable of adjustment of line length to compensate for wave, swell and tidal action, such ability to compensate is limited to the device's unpowered capacity to retrieve line.

What is needed is marker buoy which a marker buoy capable of fully autonomous operation and which requires no involvement by an operator in deploying, during deployment or upon retrieval of the buoy. Advantage may also be found in a marker buoy which once deployed, automatically energizes its lights during night anchoring, and de-energizes the lights during daytime.

Advantage may also be found in a marker buoy configured to automatically retrieve or deploy line to compensate for the rise and fall of the surface of the water as the tide rises and falls, thereby maintaining a position of the marker buoy that is substantially above the anchor on the water's surface. Advantage may also be found in a providing a marker buoy that accommodates the forces of wave action by absorbing the changes in wave height while maintaining positive buoyancy in a position that is substantially above the anchor on the water's surface. Additional advantage may be found in providing a marker buoy that is capable of deploying additional line when a selected line tension is sensed or retracting excess line when slack in the line is present.

Similarly advantage may be found in a marker buoy configured such that as a tension in the line attaching the marker buoy to an anchor decreases, the marker buoy rotates on its axis causing the energization of a motor adapted to retract the line. Advantage may also be found in a marker buoy that includes a controller having a motion responsive device that activates a motor operatively coupled to the line spool to retract line the line.

Additional advantage may be found in providing a marker buoy that automatically retracts line as anchor is raised. Advantage may also be found in a marker buoy which is configured so that upon retrieval, the buoy automatically turns off all but its charging operations.

Broadly speaking then, one objective of the present invention is to provide a marker buoy capable of fully autonomous operation and which requires no involvement by an operator in deploying, during deployment or upon retrieval of the buoy. The advantage to marking of a vessel's anchor provides valuable information to others entering an area for anchorage by aiding decisions of anchor scope as well as identifying areas of open anchorage. Another objective of the present invention then is to reduce the probability of inadvertent vessel to vessel collisions, tangled lines improving efficiencies in vessel placement.

Another objective of the present invention therefore is to provide a marker buoy that accommodates the forces of wave, swell and tidal action by absorbing the changes in the relative depth of water in which the anchor is set while maintaining positive buoyancy in a position that is substantially above the anchor on the water's surface. Additional advantage may be found in providing a marker buoy that is capable of deploying additional line when a selected line tension is sensed or retracting excess line when slack in the line is present.

Another objective of the present invention is to provide a marker buoy configured such that as a tension in the line attaching the marker buoy to an anchor exceeds a pre-selected tension, the buoy automatically deploys line until a desired line tension is once again achieved. Yet another objective of the present invention is to provide a marker buoy that includes a controller having a motion activated switch that activates a motor to operate a line spool to retract line and apply tension to the line.

SUMMARY OF THE INVENTION

Accordingly, the present invention is directed to a marker buoy for marking and maintaining a location on a surface of a water body vertically above an anchor deployed in the water body, the marker buoy including a housing having a substantially watertight compartment and a spool mounted in an adjacent spool bay. A line for attachment to the anchor is wound onto the spool. When a force of tension on the line falls below the selected tension, a center of mass of the device rotates about an axis of rotation of the device. A control device responsive to such rotation causes energization of an electric motor coupled to the spool that operates until the force of tension on the line is again within the selected range of line tensions. The marker buoy is capable of autonomous operations, during lowering of the anchor, during operation to maintain a location vertically above the anchor, during retrieval of the anchor and attached marker buoy and during a docked state.

In a preferred embodiment, the marker buoy exhibits four states of fully autonomous operation, while docked, during an anchor lowering operation, during a position maintenance state and during retrieval of the anchor. In a preferred embodiment, the marker buoy includes a housing that houses a spool that holds a line for attachment to an anchor. The housing includes a watertight compartment that contains an electric motor operatively coupled to the spool. A combination of a magnetic clutch and a torsion spring attached between the clutch and the motor work in conjunction to maintain a selected line tension and thereby a position of the marker buoy vertically above the anchor. A battery provides power for the motor and one or more beacon lights. A solar panel charges the battery. The device also includes a controller for controlling various operation of the buoy including sensing when the buoy has rolled past a preselected axial orientation, (a slack line condition), energizing the motor to retract line, sensing a pre-selected tension on the line, de-energizing the motor, sensing daylight and low light condition, switching the light(s) on and off and controlling battery charging functions.

In one embodiment, the controller includes means responsive to the tipping of the buoy on an axis, indicating a slack line between the buoy and anchor to activate a motor operatively coupled to the line spool. In a preferred embodiment, a control circuit includes a control switch that trips when the buoy tips past a selected orientation to activate the motor operatively coupled to the line spool.

DETAILED DESCRIPTION

Figure 1:
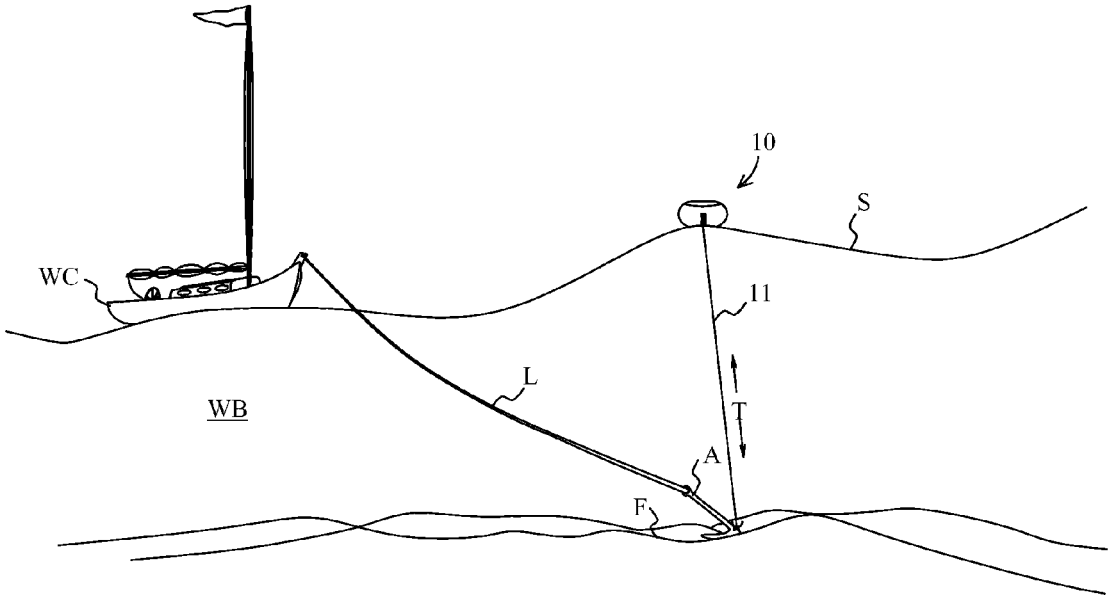
FIG. 1 is a representative perspective view of a deployed marker buoy according to the present invention.

Referring to FIG. 1 marker buoy 10 is shown attached to anchor A by line 11. Marker buoy 10 is shown maintaining positive buoyancy on surface S in a position that is located substantially above anchor A on the surface S of water body WB which anchors watercraft WC to floor F of water body WB.

Figure 2:
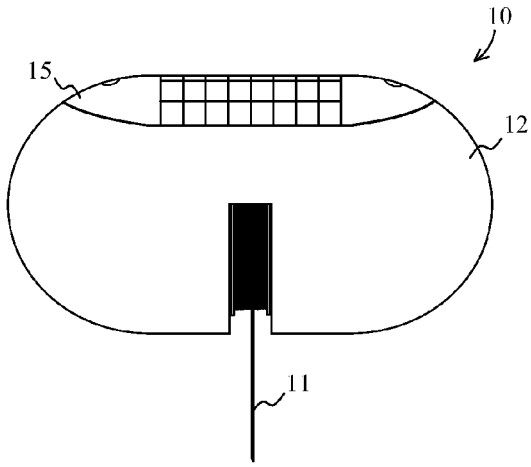
FIG. 2 is a representative front view of a marker buoy according to the present invention.
Figure 3:
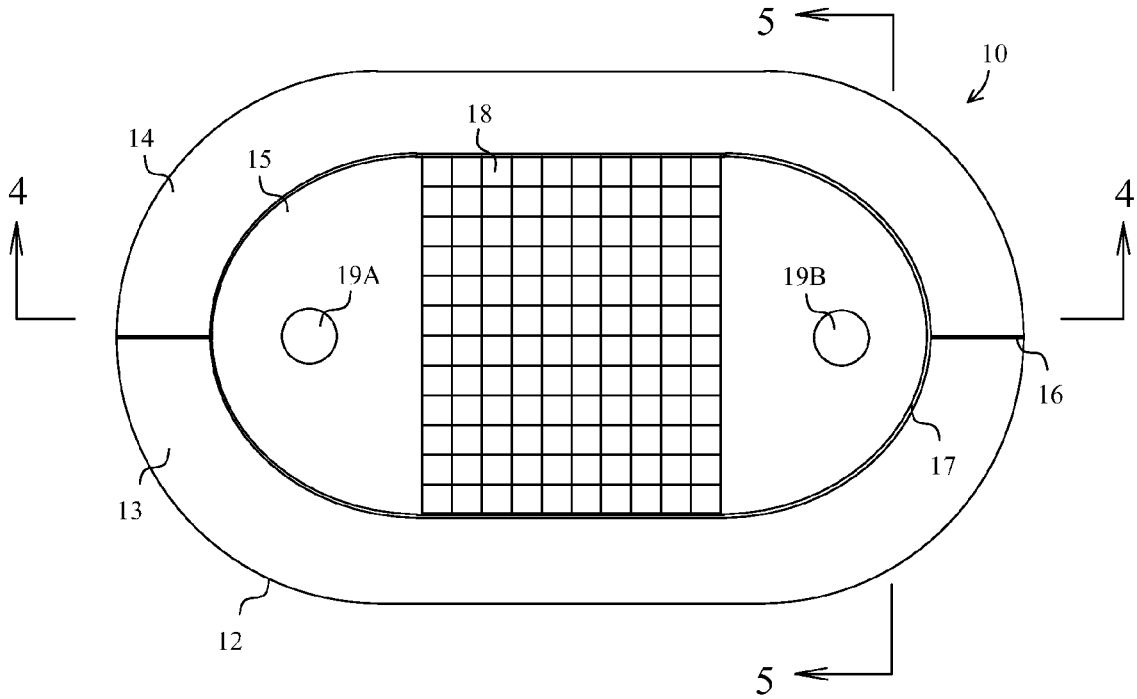
FIG. 3 is a representative top view of a marker buoy according to the present invention.
Figure 4:
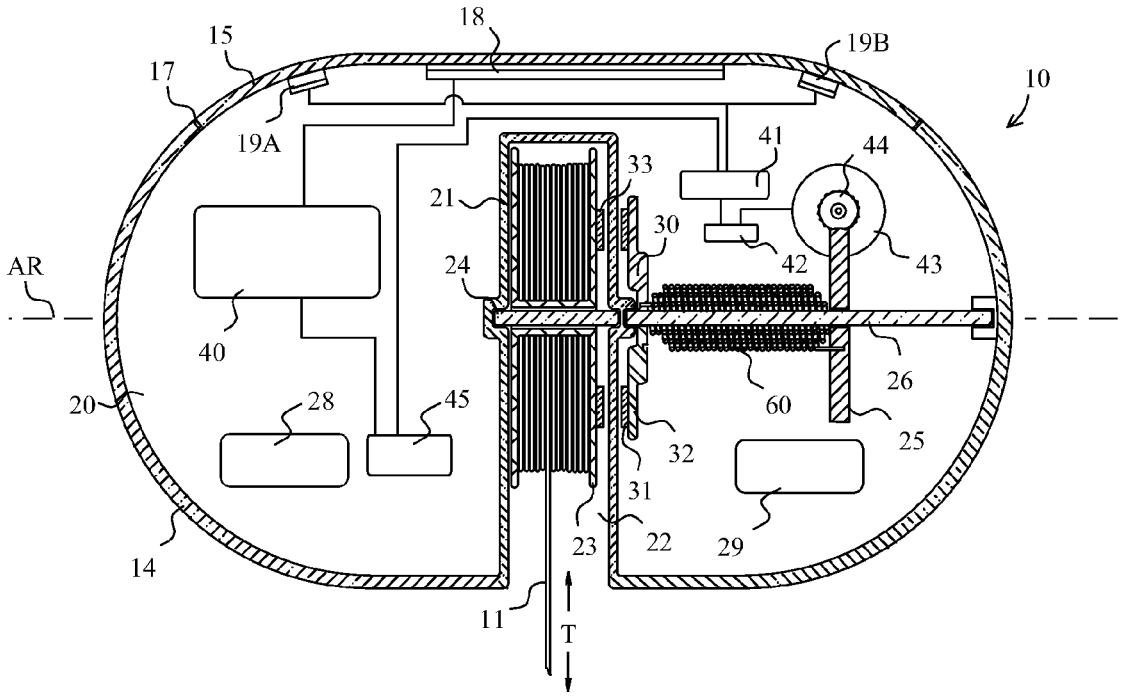
FIG. 4 is a representative front cutaway view of a marker buoy according to the present invention.

FIG. 2 shows marker buoy 10 including housing 12 having a translucent top panel 15. FIG. 3 shows a three piece construction of housing 12 including first housing side 13 joined at watertight joint 16 to second housing side 14. Translucent top panel 15 is joined to first and second housing sides 13 and 14 at watertight joint 17. FIGS. 3 and 4 show solar panel 18 and lights 19A and 19B positioned beneath translucent panel 15.

FIG. 4 is a representative side cutaway view of marker buoy 10 showing a section of translucent top panel 15 joined to second housing side 14 at watertight joint 17. As seen in FIG. 4, the shown section of translucent top panel 15 and second housing side 14 define one half of watertight compartment 20. Also shown in FIG. 4 is one half of partition 21 which surrounds and defines spool bay 22. Spool 23 is shown supported by and rotatable on spool shaft 24 within spool bay 22. In the embodiment shown, spool bay 22 is non-watertight while watertight compartment 20 remains substantially moisture free for the protection of the contained components.

Components contained within watertight compartment 20 include drive gear 25 shown supported by and rotatable on shaft 26. Electric motor 43 and its attached helical gear 44 which provides rotational force to drive gear 25. Magnetic clutch 30 includes a first plurality of clutch magnets 31 mounted to an inner face of clutch body 32 and a cooperating second plurality of clutch magnets 33 mounted on a side of spool 23. A force of magnetic attraction between the first plurality of clutch magnets 31 and the second plurality of clutch magnets 33 mounted on a side of spool 23 achieve operative connection between electric motor 43 and spool 23 without the use of sealed bearings and shafts. The use of magnetic clutch 30 in marker buoy 10 allows those components that preferably should remain moisture free to be housed within a watertight environment while still permitting the operative coupling with spool 23 which invariably will be subjected to moisture during operations of marker buoy 10. Torsion spring 60 is connected between drive gear 25 and magnetic clutch 30 to facilitate un-powered line take-up and pay-out of line 11 as described more fully below.

FIG. 4 also shows contained within watertight compartment 20, solar panel 18 conductively connected to battery 40. Battery 40 provides for the power requirements of lights 19A and 19B as well as energy required for operation of electric motor 43. Control device 42 is conductively connected between controller 41 and electric motor 43. During daylight conditions, solar panel 18 provides charging current to battery 40. Controller 41 is configured to interpret a drop in charging current as corresponding to a relatively low ambient light condition, (i.e. dusk, dark or heavy cloud cover, one hundred foot candles of illumination or less), and consequently activates lights 19A and 19B. Docking switch 45 and retainer magnets 28 and 29 are also shown contained within watertight compartment 20 and are utilized as described below.

Figure 5:
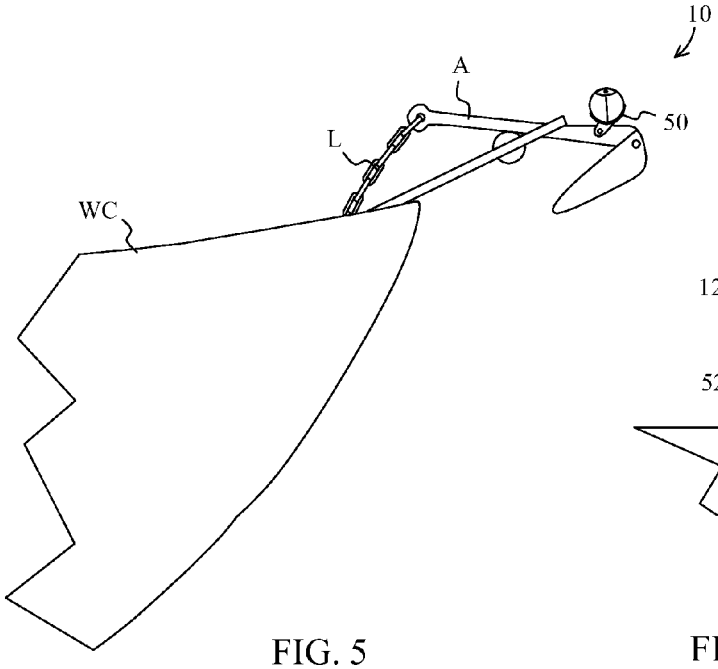
FIG. 5 is a representative side view of a docked marker buoy according to the present invention.
Figure 6:
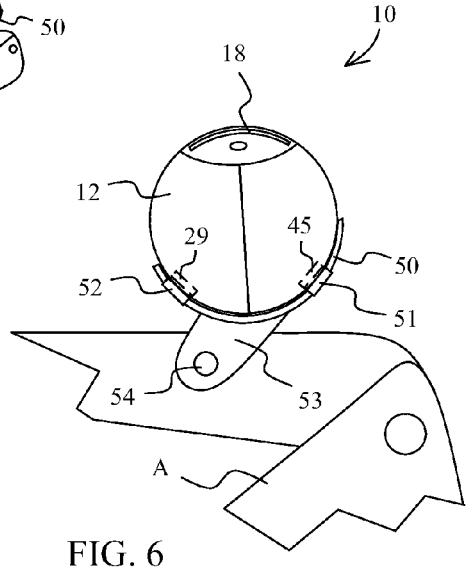
FIG. 6 is a representative side detail view of a docked marker buoy according to the present invention.
Figure 7:
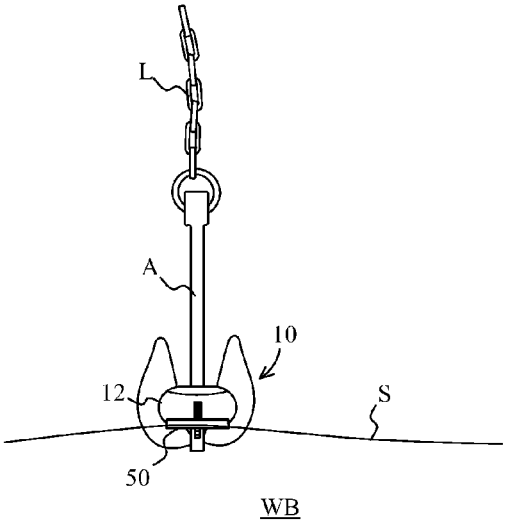
FIG. 7 is a representative front view of a docked marker buoy according to the present invention.
Figure 8:
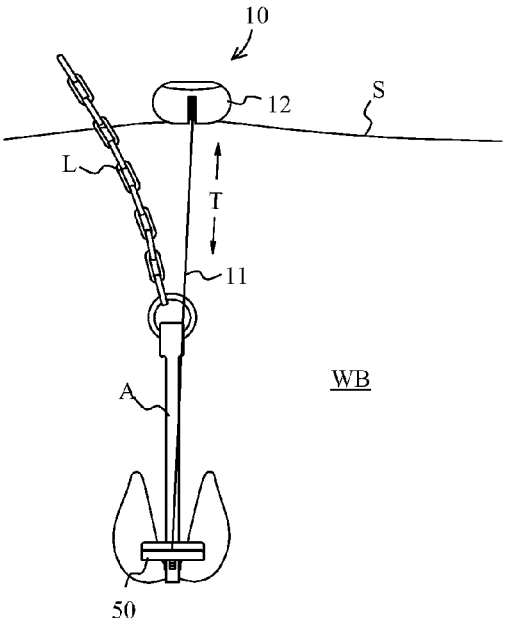
FIG. 8 is a representative front view of a deployed marker buoy according to the present invention.

Marker buoy 10 may exhibit four states of fully autonomous operation: during a docked state while docked in cradle 50 as shown in FIGS. 5 and 6; during an anchor lowering state while anchor A is being lowered on its line L, as shown in FIGS. 7 and 8; during a position maintenance state while anchor A is set at depth, for instance on floor F of water body WB as shown in FIG. 1; and during a retrieval state where anchor A is raised on its line L, as alternately depicted in FIGS. 7 and 8.

As seen in FIGS. 5 and 6, anchor A is secured in the bow of watercraft WC on line L and marker buoy 10 is docked in cradle 50. Cradle 50 includes ear 53 that is attached to anchor A by fastener 54. As anchor A is hauled aboard watercraft WC, marker buoy 10 is pulled into docking cradle 50 by operation of electric motor 43 retrieving line 11 onto spool 23, (shown in FIG. 4). During a docked state marker buoy 10 is retained in cradle 50 and magnetic docking switch 45, shown in FIGS. 4 and 6, responds to a magnetic field of docking magnet 51 seen in FIG. 6 attached to cradle 50, to terminate all electrical functions of marker buoy 10 with the exception of the continued operation of the charging circuit including solar panel 18. A magnetic attraction force between one or more retainer magnets 52, seen in FIG. 6, and opposing retainer magnets 28 and 29, shown in FIG. 4, and retainer magnet 29 shown in FIG. 6 located in housing 12 magnetically retain marker buoy 10 in cradle 50.

Referring to FIGS. 7 and 8, during an anchor lowering state of operation, marker buoy 10 is lowered with anchor A on its line L into water body WB. As marker buoy 10 reaches surface S of water body WB, the force of attraction of retainer magnets 28, 29 and 52 described above, continue to retain marker buoy 10 in cradle 50 until the force of buoyancy of marker buoy 10 exceeds the force of such magnetic attraction, at which time marker buoy 10 is freed from cradle 50 and floats on surface S.

Figure 9:
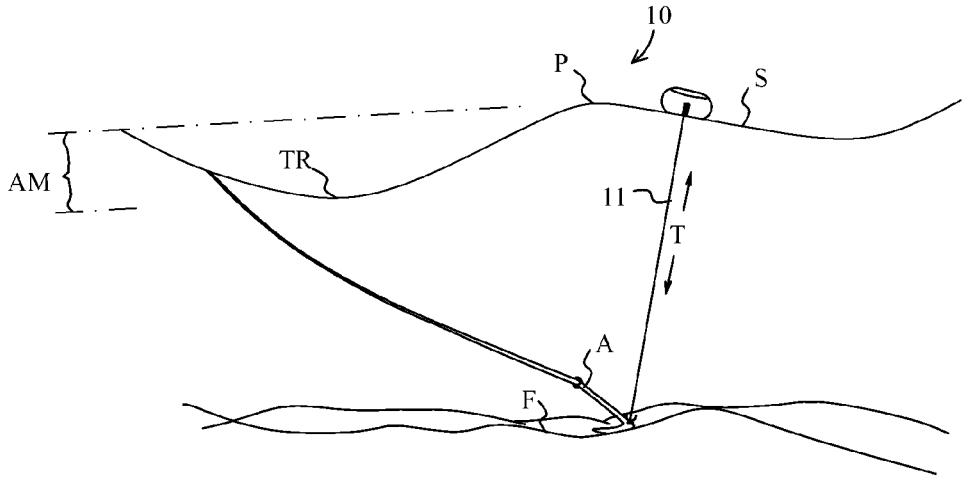
FIG. 9 is a representative perspective view of a deployed marker buoy according to the present invention
Figure 10:
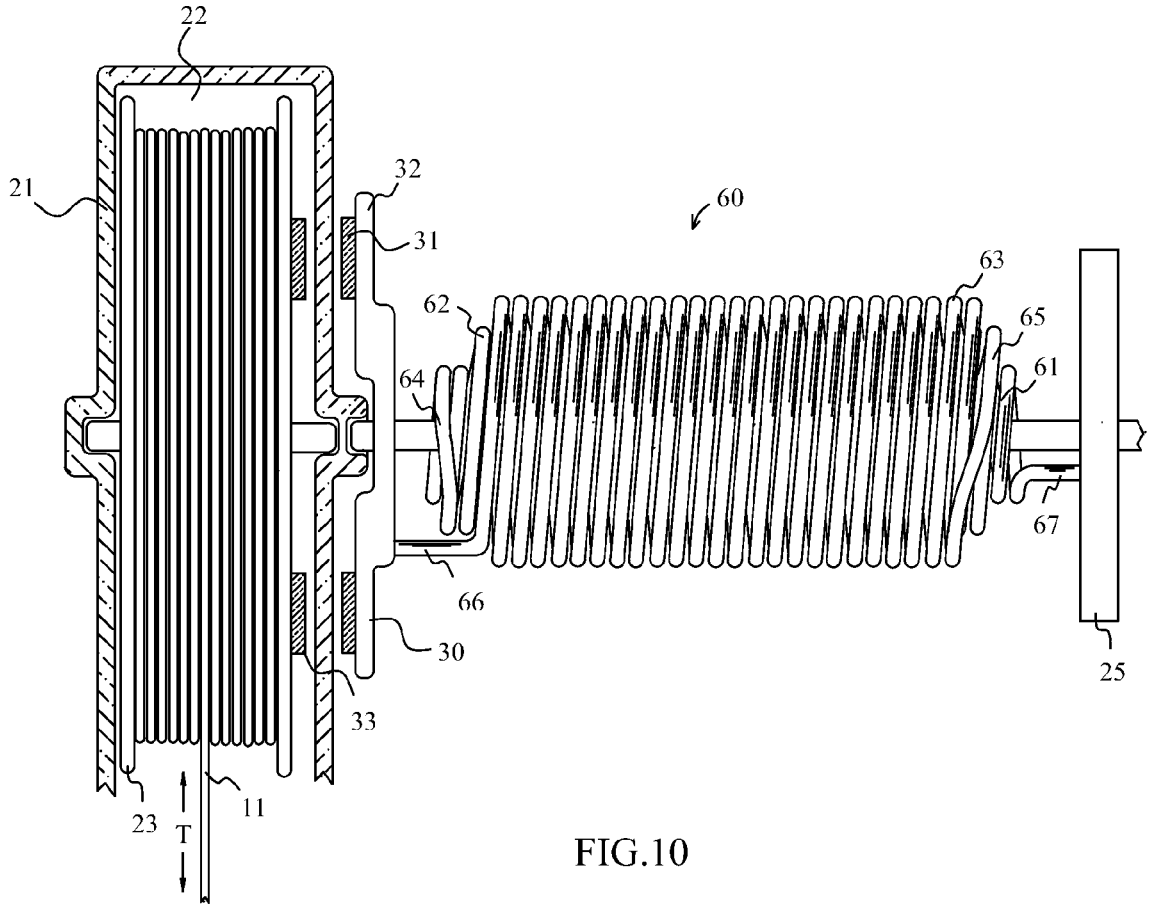
FIG. 10 is a representative front detail partial cutaway view of a marker buoy according to the present invention.

As anchor A continues its fall as shown in FIG. 9 the pull of anchor A and the resulting tension T on line 11 that attaches marker buoy 10 to anchor A exceeds a resistance of magnetic clutch 30 to the counter-rotation of spool 23, shown in FIG. 10 and line 11 begins to pay out. More particularly, and with continued reference to FIG. 10, the force of the magnetic attraction between the plurality of clutch magnets 31 mounted to the inner face of clutch body 32 and the plurality of clutch magnets 33 mounted to the outer face 34 of spool 23 is exceeded by the force of tension T on line 11 and counter-rotation of spool 23 begins, albeit against the continued resistance of magnetic clutch 30, controlling a speed of counter-rotation of spool 23 so as to prevent backlash of line 11.

Once anchor A has been set at depth on floor F of water body WB as shown in FIG. 9, a state of position maintenance initiates. Marker buoy 10 and its position vertically above anchor A on surface S may be acted on by wave action, swells and or tidal action. In order to maintain a position that is substantially above anchor A on surface S as shown in FIG. 9, maintaining positive yet controlled buoyancy, marker buoy 10 is adapted to alternately and autonomously pay out and retract line 11 to compensate for an amplitude AM between peaks P and troughs TR associated with wave action and swells or correspondingly the high and low levels.

Referring to FIGS. 9 and 10, initially the combination of magnetic clutch 30 and torsion spring 60 work in conjunction to maintain a selected line tension T and thereby a position of marker buoy 10 vertically above anchor A. As marker buoy 10 rides a wave or swell to a peak P, (or correspondingly rises with a rising tide), line 11 is paid out by counter-rotation of spool 23, which in turn causes counter-rotation of magnetically coupled magnetic clutch 30, which in turn imparts a counter-rotational force against attached tension spring 60 increasing tension in tension spring 60. Conversely, as marker buoy 10 rides a wave or swell to trough TR, (or correspondingly as surface S lowers with a lowering tide), line 11 is retracted by release of tension on tension spring 60 and a corresponding rotation of magnetically coupled magnetic clutch 30 and spool 23 causing retraction and re-tensioning of line 11.

Referring to FIG. 10, the preferred embodiment of the invention includes torsion spring 60, which is configured as a multi-stage coil spring having an inner spring coil winding 61 including a first plurality of windings of a first diameter, a center spring coil winding 62 including a second plurality of windings of a second diameter and an outer spring coil winding 63 including a third plurality of windings of a third diameter. Inner spring coil winding 61 is attached to center spring coil winding 62 at first transition winding 64 and center spring coil winding 62 attaches to outer spring coil winding 65. As shown in FIG. 10, torsion spring 60 includes first end 66 connected to magnetic clutch 30 and second end 67 attached to drive gear 25. The advantage provided by the unique configuration of tension spring 60 lies in the fact that for its length, it has a far greater capacity to undergo angular offset than a single stage coil spring having the same diameter, length, wire size and coils per unit of measurement. As such, and in a preferred embodiment of the invention, torsion spring 60 is capable of accommodating amplitudes in waves or swells up to 5 feet. Alternately, torsion spring 60 of the present invention is capable of accommodating amplitudes in waves or swells in the range of 0 to 5 feet. This range of course may be varied by employing multi-stage coil springs having different diameters, lengths, wire sizes and coils per unit of measurement.

In the event that a torsional load on torsion spring 60 exceeds a force of the magnetic attraction between the opposing plurality of magnets 31 and 33 of magnetic clutch 30, such as during an event of submersion which may occur when dropping anchor A or alternately when rise in tide or the amplitude AM of a wave or swell at its peak P exceeds a capacity for angular offset of torsion spring 60, tension T in line 11 overcomes the magnetic force between the plurality of magnets 31 and 33 and spool 23 counter-rotates against the resistance of electric motor 43 to unpowered counter-rotation thereby unspooling line 11 until tension T in line 11 is less than the magnetic force between the opposing plurality of magnets 31 and 33. At this point, magnetic clutch 30 magnetically couples again with spool 23 to maintain the desired tension T in line 11. At that time, torsion spring 60 once again provides a working range of tension T on line 11 providing automatic compensation for the action of waves, swells and tides.

Figure 11:
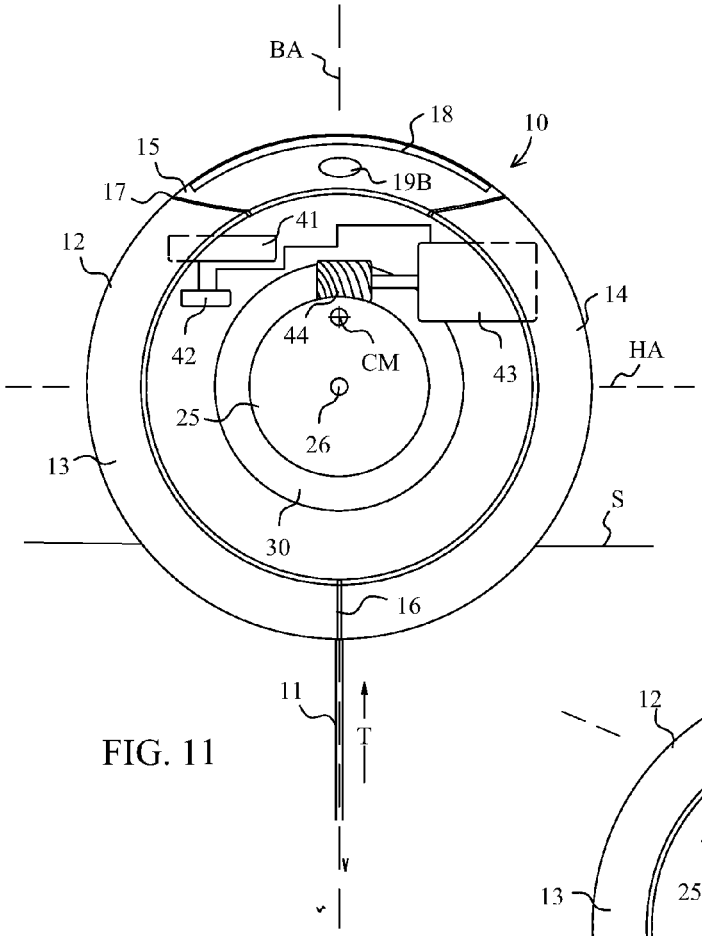
FIG. 11 is a representative side cutaway view of a marker buoy according to the present invention.
Figure 12:
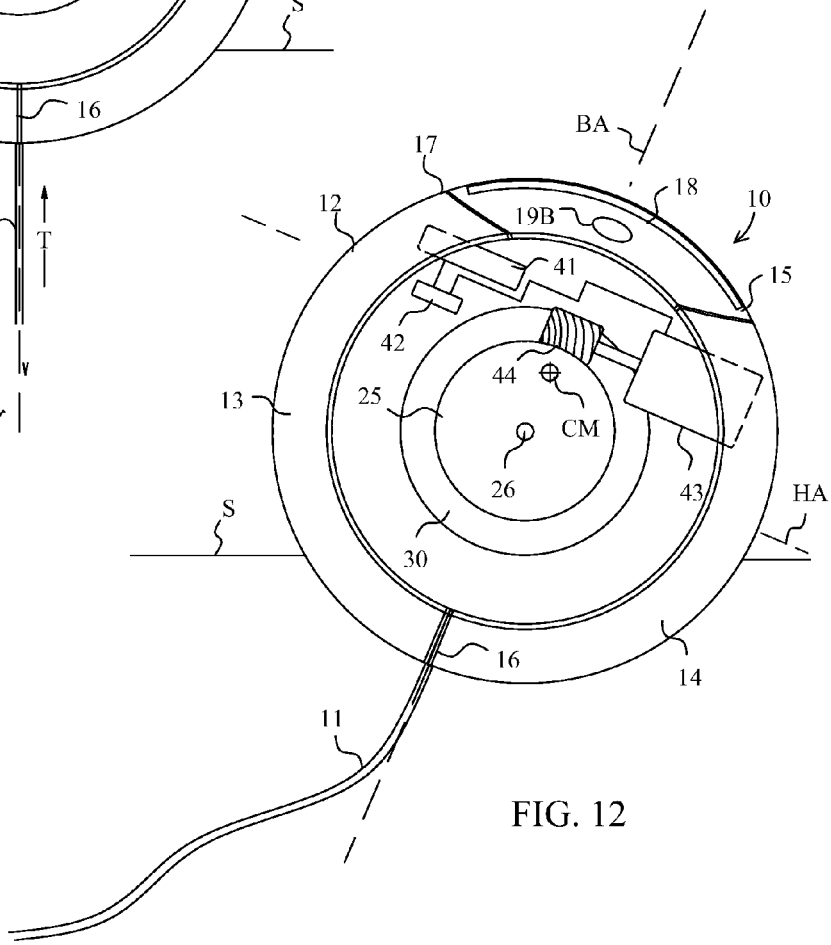
FIG. 12 is a representative side cutaway view of a marker buoy according to the present invention.

Referring to FIGS. 11 and 12, operation of marker buoy 10 in the event of a dropping water level that exceeds the capacity of torsion spring 60 to retract line 11 or upon weighing or raising of anchor A as seen in FIGS. 7 and 8 is discussed. When deployed and in a state wherein tension T on line 11 is within a selected range, marker buoy 10 is oriented substantially as shown in FIG. 11, that being with vertical axis VA exhibiting a substantially vertical orientation and horizontal axis HA lying in a substantially horizontal plane. As surface S of the water upon which marker buoy 10 is floating lowers, (or alternately as anchor A is raised), and due to the shape, weight distribution and resulting center of gravity of marker buoy 10, as line 11 slackens as seen in FIG. 12, vertical axis VA of marker buoy 10 tilts. Once vertical axis VA has tilted beyond a selected angular offset as seen in FIG. 12, control device 42 which is responsive to such tilting energizes electric motor 43, applying a rotational force to helical gear 28, rotating drive gear 25 on shaft 26.

Referring again to FIG. 4, as drive gear 25 rotates, torque is transmitted to magnetic clutch 30 through torsion spring 60. As magnetic clutch 30 begins to rotate, the magnetic attraction between opposing magnets 31 and 33 causes the rotation of spool 23 and the resulting take-up of line 11. In the preferred embodiment, electric motor 43 continues operation for three seconds in order to preload torsion spring 60, so that torsion spring 60 may resume operation in the position maintenance state. In other embodiment, electric motor 43 may continues operation for a selected period of time in the range of one to ten seconds in order to preload torsion spring 60.

Housing 12 as shown in FIGS. 1-9 and 11-12 has a generally tubular configuration with a pair of hemispherical ends, and as shown in FIG. 4, housing 12 includes an axis of rotation AR, and as shown in FIGS. 11 and 12 a vertical axis VA and a center of mass CM. As seen in FIG. 11, when tension T on line 11 is quantifiably sufficient, center of mass CM is maintained above axis of rotation AR. When tension T on line 11 is quantifiably insufficient, center of mass CM rotates about axis of rotation AR to seek equilibrium. As such it is to be understood that other housing configurations that exhibit this physical characteristic are clearly contemplated as being within the scope of the present invention.

Referring to FIGS. 7 and 8 and 11 and 12, the self-docking feature of marker buoy 10 is described. Referring to FIG. 7 as anchor A is raised on chain its line L, marker buoy 10 undergoes a serried of steps as depicted and described previously with regards to FIG. 12, that being a slackening of line 11 followed by a sensing of a tilting of buoy housing 12 on buoy axis BA due to a slack line condition, followed by a switching on of motor 43 and, referring to FIG. 4, the resulting rotation of spool 23 and take-up of line 11. As seen in FIG. 7, line 11 is attached to docking cradle 50. Spool 23 continues to rotate and take up line 11 until marker buoy 10 is pulled into docking cradle 50 as seen in FIG. 8. Referring again to FIG. 6, when marker buoy 10 is pulled into docking cradle 50, magnetic docking switch 45 responds to a magnetic field of docking magnet 51, attached to cradle 50, to terminate all electrical functions of marker buoy 10 with the exception of the continued operation of the charging circuit including solar panel 18. A magnetic attraction force between retainer magnets 52 and opposing retainer magnets 28 and 26, shown in FIG. 4, located in housing 12 magnetically retain marker buoy 10 in cradle 50.

The foregoing description of the illustrated embodiments has been presented for purposes of illustration and description and is not intended to be exhaustive or to limit the invention to the precise form or to exemplary embodiment(s) and implementation(s) disclosed. Modifications and variations will be apparent to practitioners skilled in this art. Process steps described might be interchangeable with other steps in order to achieve the same result. At least one preferred embodiment was chosen and described in order to best explain the principles of the invention and a best mode of practical application, thereby to enable others skilled in the art to understand the invention and the various modifications that are suited to the particular use or implementation contemplated. The scope of the invention is defined by the claims appended hereto and their equivalents. Reference to an element in the singular is not intended to mean "one and only one" unless explicitly so stated, but rather means "one or more." No claim element herein is to be construed under the provisions of 35 U.S.C. Sec. 112, sixth paragraph unless the element is expressly recited using the phrase "means for . . . "

What is claimed is:

1. A marker buoy for marking and maintaining a location on a surface of a water body above an anchor deployed in the water body, the marker buoy comprising:

a housing including a substantially watertight compartment, the housing also comprising a spool bay;

a spool including a spool body, the spool rotatably mounted in the spool bay;

a line wound onto the spool, the line adapted for attachment to an anchor;

an electric motor mounted within the substantially watertight compartment of the housing;

a clutch rotatably coupled between the spool and the electric motor, the clutch coupleable to the spool permitting rotation of the spool with rotation of the clutch;

a battery mounted within the substantially watertight compartment of the housing, the battery connected to the electric motor; and a control device conductively connected to the battery and the electric motor, the control device configured to activate the electric motor in response to a tilting of the housing of the marker buoy.

2. The marker buoy of claim 1 wherein the housing further comprises an axis of rotation, a vertical axis and a center of mass, the center of mass being maintainable above the axis of rotation when a force of tension on the line is within the selected range of line tensions, the center of mass rotatable about the axis of rotation of the housing when the force of tension on the line is below the selected range of line tensions.

3. The marker buoy of claim 1 wherein the spool bay further comprises a non-watertight spool bay.

4. The marker buoy of claim 1 further comprising:

the spool including one or more magnets attached to the spool; and the clutch configured as a magnetic clutch mounted within the substantially watertight compartment of the housing, the magnetic clutch rotatably coupled to the electric motor, the magnetic clutch including a clutch body and the magnetic clutch also including one or more magnets attached to the clutch body, the one or more magnets attached to the clutch body magnetically coupleable to the one or more magnets attached to the spool body permitting rotation of the spool with rotation of the magnetic clutch.

5. The marker buoy of claim 1 further comprising:

a drive gear supported by and rotatably mounted on a shaft, the drive gear rotatably coupled to the electric motor;

the clutch rotatably mounted on the shaft; and a torsion spring connected between the electric motor and the clutch, the torsion spring configured to be placed under increasing tension as the spool counter-rotates to dispense line, the torsion spring further configured to release tension rotating the spool to retract line.

6. The marker buoy of claim 1 wherein the control device further comprises tilt sensing switch conductively connected to the battery and the electric motor, the tilt sensing switch responsive to a tilting of the housing of the marker buoy to selectively energize and de-energize the electric motor.

7. The marker buoy of claim 1 further comprising:

a solar panel conductively connected to the battery, the solar panel configured to generate a charging current for the battery; and a controller conductively connected to the battery, the solar panel and the electric motor, the controller configured to interpret a drop in charging current from the solar panel as corresponding to a relatively low ambient light condition.

8. The marker buoy of claim 1 further comprising:

a solar panel conductively connected to the battery, the solar panel adapted to generate a charging current for the battery;

a controller conductively connected to the battery, the solar panel and the electric motor, the controller configured to interpret a drop in charging current from the solar panel as corresponding to a relatively low ambient light condition; and a light conductively connected to the controller, the controller configured to energize the light during relatively low ambient light conditions.

9. The marker buoy of claim 1 further comprising:

a controller conductively connected to the battery, the solar panel and the electric motor, the controller configured to interpret a drop in charging current from the solar panel as corresponding to a relatively low ambient light condition; and a light conductively connected to the controller, the controller configured to energize the light during relatively low ambient light conditions, the controller further configured to de-energize the light during daylight conditions;

a docking cradle attached to the anchor;

a magnetic docking switch conductively connected to the controller, the magnetic docking switch responsive to a magnetic field of a magnet attached to the docking cradle to terminate select electrical functions of the marker buoy.

10. An autonomously operational marker buoy configured to mark and maintain a location substantially above an anchor on the surface of a water body, the marker buoy comprising:

a housing including a substantially watertight compartment, the housing also comprising a spool bay;

a spool including a spool body, the spool rotatably mounted in a spool bay, the spool including one or more magnets attached to the spool;

a line wound onto the spool, the line adapted for attachment to an anchor;

an electric motor mounted within the substantially watertight compartment of the housing;

a magnetic clutch mounted within the substantially watertight compartment of the housing, the magnetic clutch operatively connected between the electric motor and the spool, the magnetic clutch including a clutch body including one or more magnets, the one or more magnets magnetically coupleable with the one or more magnets attached to the spool body permitting rotation of the spool with rotation of the magnetic clutch;

a battery mounted within the substantially watertight compartment of the housing, the battery connected to the electric motor;

a solar panel conductively connected to the battery, the solar panel configured to generate a charging current for the battery; and a control device conductively connected to the battery and the electric motor, the control device configured to activate the electric motor in response to a tilting of the housing of the marker buoy.

11. The marker buoy of claim 10 wherein the housing further comprises an axis of rotation, a vertical axis and a center of mass, the center of mass being maintainable above the axis of rotation when a force of tension on the line is within the selected range of line tensions, the center of mass rotatable about the axis of rotation of the housing when the force of tension on the line is below the selected range of line tensions.

12. The marker buoy of claim 10 further comprising:

a drive gear supported by and rotatably mounted on a shaft, the drive gear rotatably coupled to the electric motor;

the magnetic clutch rotatably mounted on the shaft; and a torsion spring connected between the electric motor and the magnetic clutch, the torsion spring configured to be placed under increasing tension as the spool counter-rotates to dispense line, the torsion spring further configured to release tension rotating the spool to retract line.

13. The marker buoy of claim 10 wherein the control device further comprises a tilt sensing switch conductively connected to the battery and the electric motor, the tilt sensing switch responsive to a tilting of the housing of the marker buoy to selectively energize and de-energize the electric motor.

14. The marker buoy of claim 10 further comprising:

a controller conductively connected to the battery and the solar panel, the controller configured to interpret a drop in charging current from the solar panel as corresponding to a relatively low ambient light condition; and a light conductively connected to the controller, the controller configured to energize the light during relatively low ambient light conditions.

15. The marker buoy of claim 10 further comprising:

a controller conductively connected to the battery and the solar panel, the controller configured to interpret a drop in charging current from the solar panel as corresponding to a relatively low ambient light condition;

a light conductively connected to the controller, the controller configured to energize the light during relatively low ambient light conditions;

a docking cradle attached to the anchor; and a magnetic docking switch conductively connected to the controller, the magnetic docking switch responsive to a magnetic field of a magnet attached to the docking cradle to terminate select electrical functions of the marker buoy.

16. An autonomously operational marker buoy configured to mark and maintain a location substantially above an anchor on the surface of a water body, the marker buoy comprising:

a housing including a substantially watertight compartment and the housing also comprising a spool bay;

a spool including a spool body, the spool rotatably mounted in the spool bay, the spool including one or more magnets attached to the spool body;

a line wound onto the spool, the line adapted for attachment to an anchor;

an electric motor mounted within the substantially watertight compartment of the housing;

a magnetic clutch operatively connected between the electric motor and the spool, the magnetic clutch including a clutch body including one or more magnets, the one or more magnets magnetically coupleable with the one or more magnets attached to the spool body permitting rotation of the spool with rotation of the magnetic clutch;

a torsion spring connected between the electric motor and the magnetic clutch, the torsion spring configured to be placed under increasing tension as the spool counter-rotates to dispense line, the torsion spring further configured to release tension rotating the spool to retract line;

a battery mounted within the substantially watertight compartment of the housing, the battery connected to the electric motor;

a solar panel conductively connected to the battery, the solar panel adapted to charge the battery;

a control device conductively connected to the battery and the electric motor, the control device responsive to a tilting of the housing of the marker buoy to selectively energize and de-energize the electric motor;

a controller conductively connected to the solar panel and the battery;

a light conductively connected to the controller, the controller configured to energize the light during low ambient light conditions, the controller further configured to de-energize the light during daylight conditions.

17. The marker buoy of claim 16 wherein the housing further comprises an axis of rotation, a vertical axis and a center of mass, the center of mass being maintainable above the axis of rotation when a force of tension on the line is within the selected range of line tensions, the center of mass rotatable about the axis of rotation of the housing when the force of tension on the line is below the selected range of line tensions.

18. The marker buoy of claim 16 further comprising:

a drive gear supported by and rotatably mounted on a shaft, the drive gear rotatably coupled to the electric motor;

the magnetic clutch rotatably mounted on the shaft; and the torsion spring connected between the drive gear and the magnetic clutch, the torsion spring configured to be placed under increasing tension as the spool counter-rotates to dispense line, the torsion spring further configured to release tension rotating the spool to retract line.

19. The marker buoy of claim 16 wherein the control device further comprises a tilt sensing switch conductively connected to the battery and the electric motor, the tilt sensing switch responsive to a tilting of the housing of the marker buoy to selectively energize and de-energize the electric motor.

20. The marker buoy of claim 16 further comprising:

a docking cradle attached to the anchor; and a magnetic docking switch conductively connected to the controller, the magnetic docking switch responsive to a magnetic field of a magnet attached to the docking cradle to terminate select electrical functions of the marker buoy.

* * * * *